United States Patent [19]

Klocke

[11] Patent Number: 4,918,875

[45] Date of Patent: Apr. 24, 1990

[54] HAND-HELD SANDING DEVICE

[76] Inventor: Kenneth J. Klocke, 206 - 20th St., East, West Fargo, N. Dak. 58078

[21] Appl. No.: 196,017

[22] Filed: May 19, 1988

[51] Int. Cl.[5] ..... B24B 9/10

[52] U.S. Cl. ..... 51/370; 51/358

[58] Field of Search ..... 51/370, 388, 358, 391, 51/364, 366, 392, 393, 367

[56] References Cited

U.S. PATENT DOCUMENTS

| | | | |
|---|---|---|---|
| 1,730,239 | 10/1929 | Peters | 51/366 |
| 2,112,593 | 3/1938 | Campbell | 51/370 |
| 2,555,946 | 6/1951 | Trussell | 51/391 |
| 3,623,280 | 11/1971 | Chestnut | 51/370 |
| 3,952,457 | 4/1976 | Gutierrez | 51/354 |

FOREIGN PATENT DOCUMENTS

| | | | |
|---|---|---|---|
| 7609814 | 9/1976 | Netherlands | 51/391 |

*Primary Examiner*—Judy Hartman
*Assistant Examiner*—Maurina Rachuba
*Attorney, Agent, or Firm*—Burd, Bartz & Gutenkauf

[57] ABSTRACT

A hand-held sanding device for use with sandpaper or other abrasive sheet material is disclosed. The sander is characterized by a generally cylindrical body of tough rugged semi-rigid resilient material having an arcuate outer face adapted to engage the back surface of a piece of abrasive sheet material. The sanding device includes means for securely holding the abrasive sheet material in tight abutting engagement with the outer face of the body. Several alternative forms of sander body are disclosed along with several different means of securing the abrasive sheet material to the bodies.

10 Claims, 3 Drawing Sheets

FIG. 1
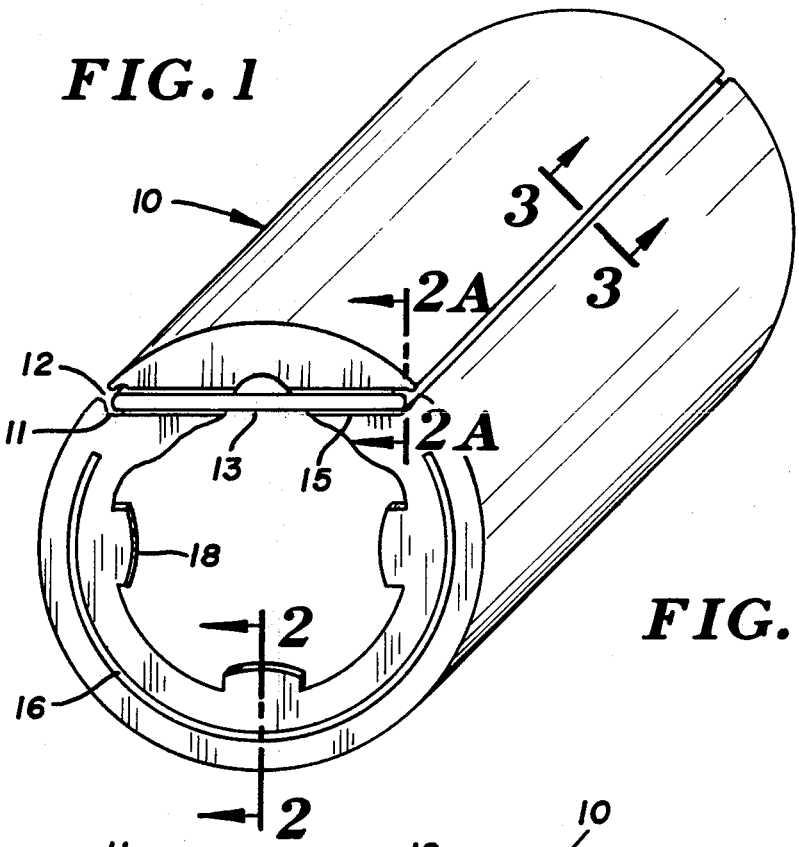
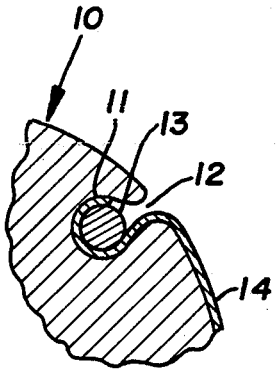
FIG. 3
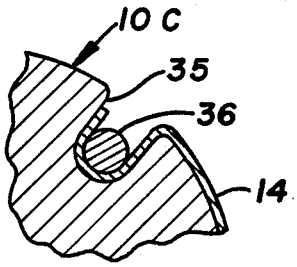
FIG. 6
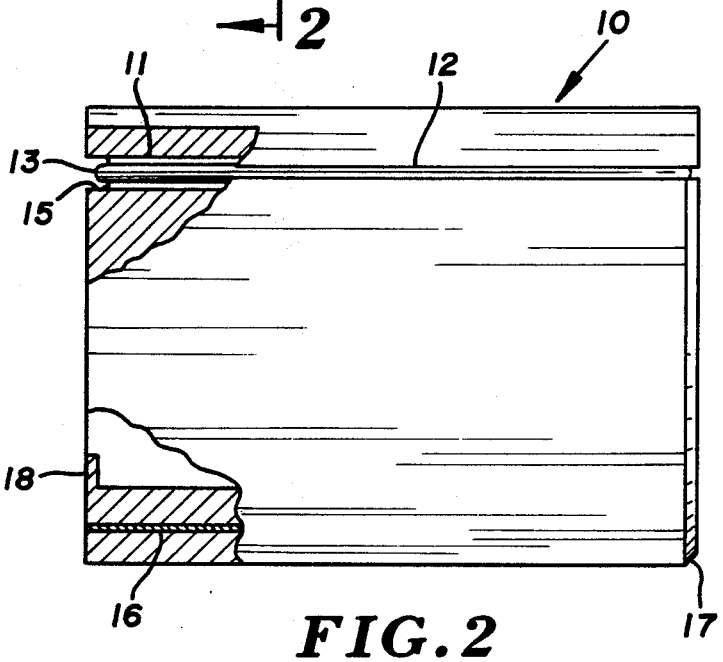
FIG. 2
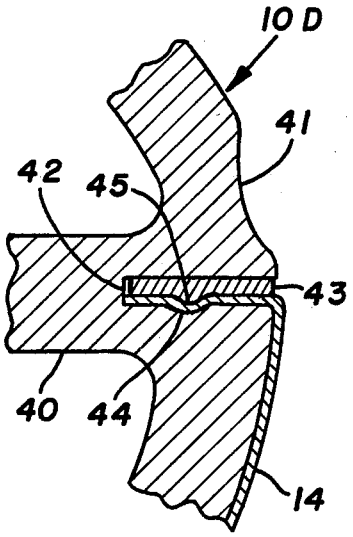
FIG. 7

HAND-HELD SANDING DEVICE

BACKGROUND OF THE INVENTION

1. Field of the Invention"

This invention is directed to a hand-held device intended for use in holding sandpaper or other abrasive sheet material for the purpose of smoothing and/or polishing surfaces, such as painted or enameled surfaces. Although not so limited, the invention is primarily intended for use in sanding non-planar surfaces, such as encountered in auto body repair and finishing work, and the like Although equally useful for dry or wet sanding, the device in its preferred form is especially adapted for wet sanding.

2. The Prior Art

The prior art is exemplified by Lukianoff U.S. Pat. No. 4,501,096 which discloses a hand-held sanding device for holding a sheet of abrasive sheet material around three intersecting faces of a resilient, generally triangular shaped block, one of which surfaces is generally curved and has a slot therein for receiving and holding the ends of a sheet of abrasive sheet material wrapped around the block.

Haney U.S. Pat. No. 4,320,601 discloses a manual sanding block including means for attaching sheets of abrasive material and adapted for connection to a source of water under pressure.

SUMMARY OF THE INVENTION

The present invention is directed to a new and improved hand-held sanding device having structure and features which offer advantages in use which are not present in the devices of the prior art.

Broadly stated, the invention comprises a hand-held sanding device, for use with sandpaper or other abrasive sheet material, which comprises a generally cylindrical body of semi-rigid resilient material having an outer arcuate face adapted to engage the back surface of a sheet of sandpaper or other abrasive sheet material over at least a substantial portion of that face, and having means for securely holding a sheet of sandpaper or other abrasive sheet material in tight abutting engagement with the body face. The invention also includes the combination of such a hand-held sanding device with a sheet of sandpaper or other abrasive sheet material firmly secured to the body of the device. Various configurations of sander body structure are disclosed, along with a variety of alternative means for attachment of sandpaper or other abrasive sheet material to the sander body.

BRIEF DESCRIPTION OF THE DRAWINGS

The invention is illustrated by the accompanying drawings in which corresponding parts are identified by the same numerals and in which:

FIG. 1 is an isometric end elevational view showing one form of hand-held sanding device according to the present invention;

FIG. 2 is a side elevation thereof with parts partially broken away and in section along the lines 2—2 and 2A—2A of FIG. 1 and in the direction of the arrows;

FIG. 3 is a partial fragmentary elevational view in section along the line 3—3 of FIG. 1 and in the direction of the arrows;

FIGS. 6 through 8 are fragmentary elevational sectional views on an enlarged scale showing various alternative forms of fastening means for holding abrasive sheet material on the hand-held sander.

DETAILED DESCRIPTION OF THE PREFERRED EMBODIMENTS

Figure 4:
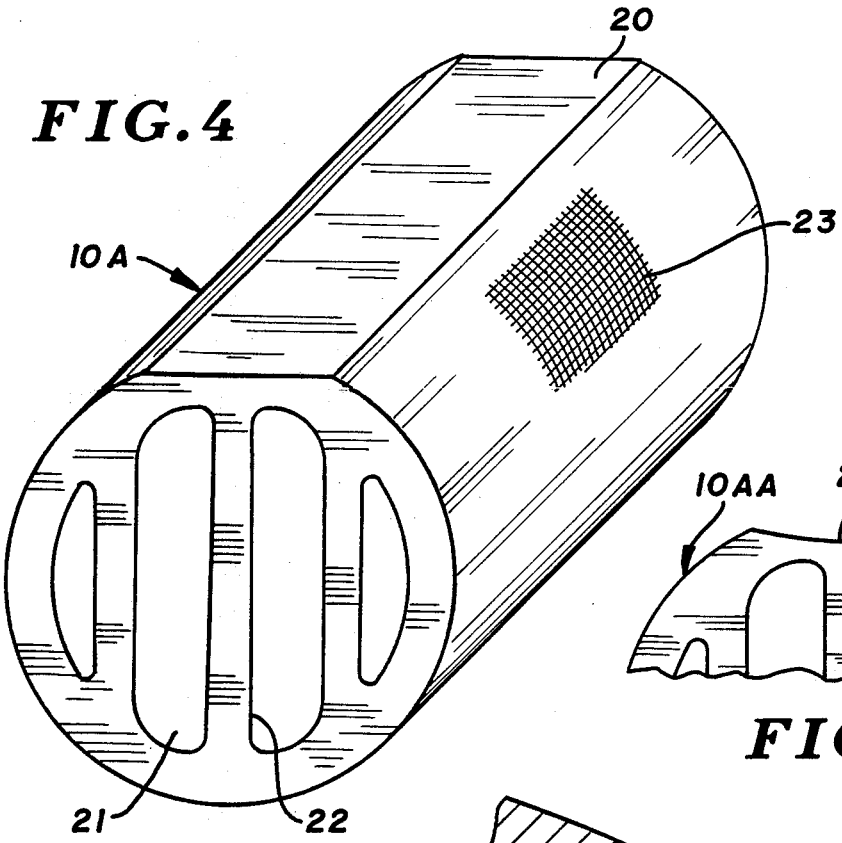
FIG. 4 is an isometric end elevational view showing an alternative form of hand-held sander according to the present invention.

Referring now to FIGS. 1 through 3, there is shown one form of hand-held sanding device according to the present invention including a generally cylindrical body indicated generally at 10. Body 10 is composed of semi-rigid resilient material so that abrasive sheet material wrapped therearound may be made to conform to arcuate surfaces of varying contours, such as commonly encountered on automobile bodies and similar finishing projects.

Body 10 may be formed from any of a variety of tough rugged synthetic resinous plastic or rubber or rubber-like materials. Exemplary materials are moldable and/or extrudible and include by way of example polystyrenes and modified polystyrenes, ABS (acrylonitrile-butadiene-styrene) resin, polyvinyl chloride and copolymers thereof, natural rubber, and the like. These materials are formulated so as to be semi-rigid, that is, to be resilient enough to permit deformation under normal manual working pressure and thus having limited flexibility. The materials are preferably formulated as closed cell foams so as to be buoyant in water. This facilitates use in wet sanding permitting easy release of accumulated sanded material from the abrasive surface and keeping the sander free from contamination by accumulated debris in the bottom of the water container.

Generally cylindrical body 10 is preferably hollow and tubular with a longitudinal channel extending through its length. The body is of a size to be easily held in the hand. Typically it may be from about $\frac{3}{4}$ inch to 7 inches in diameter and from $1\frac{1}{2}$ to 14 inches in length. In use, sand paper or other abrasive sheet material is wrapped about at least a substantial portion of the face of the body and means are provided for securely holding the abrasive sheet material.

In the embodiment shown in FIGS. 1 through 3, the means for securing the abrasive sheet material comprises a pair of parallel channels 11 formed in the body spaced about 270° apart. Each channel 11 has a restricted opening 12 having closely spaced apart opposed resilient lips which permit forcing of a fastening element 13 into the channel. The fastening member 13 may take the form of a rigid rod or tube, or as shown, it may have the form of a resilient loop. This resilient loop may be, for example, a rubber O-ring of appropriate cross section to snugly fit within the channel, or a coil spring loop, or a Bungy cord, or the like. As shown in FIG. 3, the edge of a piece of abrasive sheet material 14 is inserted into channel 11 and held in place by the fastening member 13. Preferably channels 11 are interconnected at the ends of the body 10 by a transverse channel 15 in which a loop fastening member is recessed so as to avoid accidental dislodgment and interference with the sanding operation.

The abrasive sheet material may be secured around the major portion of the generally cylindrical body between the channels 11, or the smaller minor area, or both. For example, a coarser grit material might be used in one position and a finer grit material in the other with the ends of both pieces of abrasive sheet material engaged by the fastening element in the channel.

Dependent upon the material from which the body is formed, added strength and resilience may be imparted by embedding a C-cross section spring steel member 16 in the body. At least one end edge of the body is provided with a bevel or champfer 17 around at least a substantial portion of the periphery of the body for the purpose of preventing overcuts in use. Extra abrasive sheet material may be stored within the hollow core of the sander body. Desirably one or more tabs 18 are provided to assist in holding the stored material within the body.

Figure 4A:
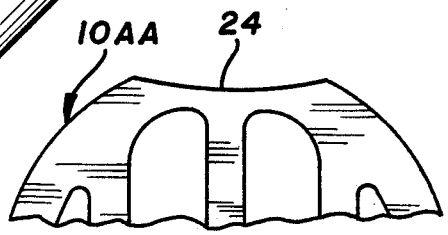
FIG. 4A is a fragmentary end elevation of a variant thereof.

Referring now to FIG. 4, there is shown a form of hand-held sander especially adapted for use with abrasive sheet material having a pressure sensitive coating on the reverse face. This alternative form of cylinder has a generally cylindrical body indicated generally at 10A. It may be formed from the same materials as previously described. The generally cylindrical body desirably has a flat surface 20 extending the length of the body over a small portion of its periphery (10 to 25%, for example) to facilitate the sanding of planar surfaces. Body 10A is hollow with several longitudinal channels 21 and intervening ribs 22 for added strength without loss of lateral resilience. The outer face of body 10A is desirably provided with a knurled or waffled surface 23 to facilitate easy removal of adhesively backed abrasive sheet material. As seen in FIG. 4A, a generally cylindrical body 10AA may be provided with a shallow concave surface 24 in lieu of a flat surface for sanding planar or convex surfaces.

Figure 5:
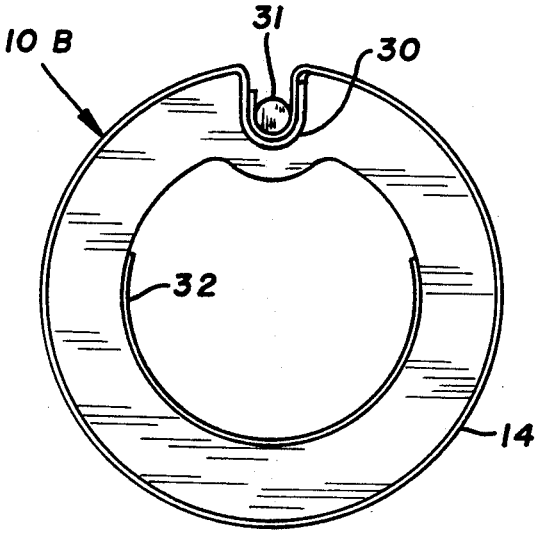
FIG. 5 is an end elevation of a further alternative form of hand-held sander.

FIG. 5 illustrates in end elevation a further alternative form of sander body 10B adapted to be substantially completely surrounded by a web of abrasive sheet material 14. The body 10B is hollow with a central longitudinal passage extending through its length. It is provided with a single longitudinal channel 30 in its outer face extending the length of the body. The opposite ends of the web of abrasive sheet material are inserted into channel 30 in overlapping configuration and held firmly in place by fastening element 31 pressed into the channel in tight frictional engagement. Fastening element 31 is in the form of an elongated rigid rod or tube. Extra abrasive sheet material may be stored within the longitudinal channel. A C-cross section spring steel clip is provided to facilitate retention of the stored abrasive sheet material within the body. FIG. 6 shows an alternative form of sander body 10C in which the sandpaper attaching means includes an open mouthed channel 35 in which the end of a web of abrasive sheet material 14 is inserted and held in place by an elongated rigid rod or tube 36 pressed into the channel with a tight fit and frictionally engaged therein. When the body 10C includes a pair of channels 35 a resilient loop such as an O-ring may be used as the retaining fastening member.

FIG. 7 shows a further alternative form of sander body 10D in which the longitudinal channel through the cylindrical body is divided by a transverse rib or web 40 for added strength without loss of resiliency. Desirably a shallow longitudinal groove 41 may be formed in the outer face of the upper portion of the sander body 10D to facilitate gripping with the hand. The means for securing a web of abrasive sheet material 14 to the body face includes a pair of narrow longitudinal slots or deep channels 42 which extend inwardly toward one another from opposite sides of the sander body. A long narrow plug or wedge 43 is adapted to fit with a tight frictional fit in each channel 42. Each channel 42 is desirably formed with a shallow longitudinal channel or groove 44. Each plug or wedge 43 is provided with a corresponding longitudinal projection or lip 45 to fit into channel or groove 44 to enhance the frictional engagement of the slot and plug. One end edge of a sheet of abrasive sheet material 14 is inserted into the slot 42 and the plug or wedge is forced therein to securely hold the abrasive sheet material in place.

Figure 8:
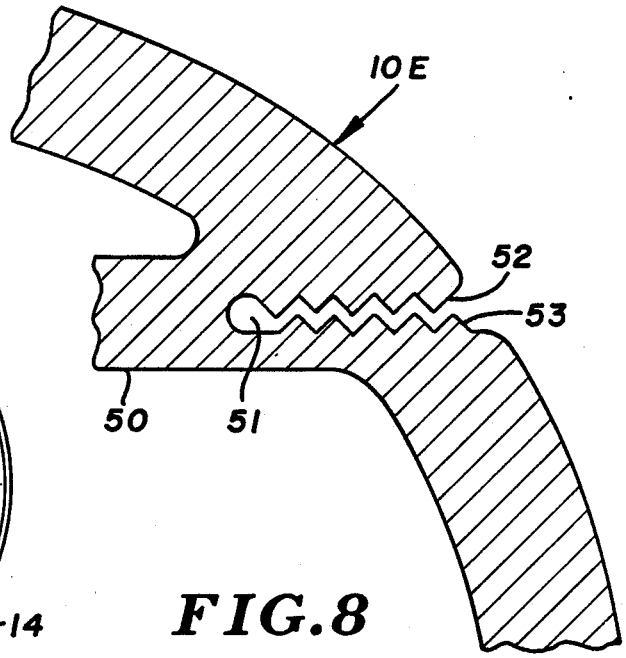

FIG. 8 shows a still further alternative form of generally cylindrical sander body 10E. This form of body includes two longitudinal channels throughout the length of the body divided by a transverse rib or web 50. The means for attachment of a piece of abrasive sheet material comprises a pair of laterally inwardly extending longitudinal slots or deep channels 51. At least one wall, and preferably both facing walls, of slot or channel 51 are provided with gripping members in the form of opposed teeth 52 and 53, or inwardly extending pins, or the like. Because of the limited resiliency of the sander body 10E, the body may be flexed sufficiently to spread the walls of slot 51 to permit the end of a piece of abrasive sheet material to be forced into the widened mouth of the slot. Then, when the slot is returned to its closed at-rest position, the abrasive sheet material is firmly and securely grasped and held in place by the teeth or pins.

Figure 9:
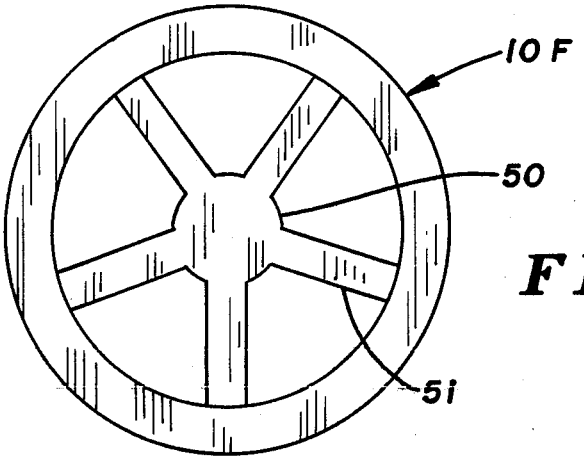
FIGS. 9 and 10 are end elevations of further alternative forms of hand-held sander.
Figure 10:
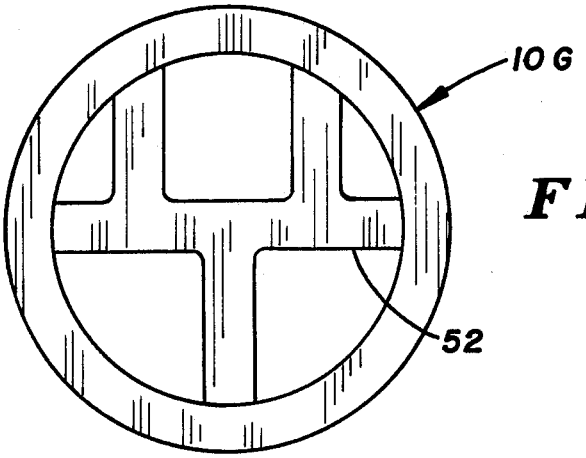

FIG. 9 illustrates in end elevation a simplified form of sander in which a generally cylindrical tubular body 10F, such as a segment of hose of appropriate size and strength, is fitted with a reinforcing molded or extruded longitudinal spider having a central hub 50 and a plurality of radially projecting fins 51. The spider may be rigid or semi-rigid. It may have three or more fins as desired. The spider is fit with a tight slide fit in the tubular body and may be removed, depending upon the requirements of the particular sanding job. This form of sander is intended for use with sandpaper or other abrasive sheet material having a back coating of pressure sensitive adhesive. FIG. 10 shows a similar cylindrical tubular body 10G having a removable spider 52 of different geometrical configuration, one of many which may be used.

It will be readily apparent that certain of the disclosed features are interchangeable among the several alternative forms of sander body. For example, a beveled or champfered edge 17 is desirably provided on all forms of sander bodies. Likewise, one flat surface 20 or shallow concave surface 24 is desirably provided on each of the forms of sander body. All are desirably provided with a knurled or waffled surface so that adhesive backed abrasive sheet material may be used with each. Spring steel reinforcement of the body may be provided as needed. All forms of sander body are desirably buoyant.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A hand-held sanding device for use with sandpaper or other abrasive sheet material, which device comprises:

(A) a generally cylindrical tubular body of tough rugged semi-rigid resilient rubber or rubber-like material having an arcuate outer face adapted to engage the back surface of a sheet of sandpaper or other abrasive sheet material over at least a substantial portion of said face, (B) a relatively narrow flat or shallow concave longitudinal panel along one side of said body, and (C) a pair of parallel spaced apart longitudinal slots or channels on opposite sides of the cylindrical body having closely spaced apart side walls for resiliently gripping the opposite parallel edges of a sheet of sandpaper or other abrasive sheet material for securely holding the abrasive sheet material in tight abutting engagement with said body face.

2. A sanding device according to claim 1 wherein said slots or channels contain means for frictionally gripping the sheet material.

3. A sanding device according to claim 2 wherein said means for frictionally gripping the sheet material comprises a plurality of inwardly extending teeth or pins on at least one wall of the slot or channel.

4. A sanding device according to claim 1 wherein at least one end edge of said body is beveled or champfered around at least a substantial portion of its periphery.

5. A sanding device according to claim 1 wherein said sanding device is buoyant.

6. In combination, a hand-held sanding device for use with sandpaper or other abrasive sheet material comprising:

(A) a generally cylindrical tubular body of tough rugged semi-rigid resilient rubber or rubber-like material having an arcuate outer face adapted to engage the back surface of a sheet of sandpaper or other abrasive sheet material;

(B) a relatively narrow flat or shallow concave longitudinal panel along one side of said body;

(C) a pair of parallel spaced apart longitudinal slots or channels on opposite sides of the cylindrical body, said slots or channels having closely spaced apart side walls; and (D) a sheet of sandpaper or other abrasive sheet material resiliently gripped by the opposite parallel edges in said slots or channels and securely held in tight abutting engagement with said body face over a substantial portion thereof.

7. A combination according to claim 6 wherein at least one end edge of said body is beveled or champfered around at least a substantial portion of its periphery.

8. A combination according to claim 2 wherein said sanding device is buoyant.

9. A sanding device according to claim 6 wherein said slots or channels contain means for frictionally gripping the sheet material.

10. A sanding device according to claim 9 wherein said means for frictionally gripping the sheet material comprises a plurality of inwardly extending teeth or pins on at least one wall of the slot or channel.

* * * * *

UNITED STATES PATENT AND TRADEMARK OFFICE

CERTIFICATE OF CORRECTION

PATENT NO. : 4,918,875

DATED : April 24, 1990

INVENTOR(S) : KENNETH J. KLOCKE

It is certified that error appears in the above-identified patent and that said Letters Patent is hereby corrected as shown below:

Column 1, line 14, a period (.) should be inserted after "like".

Column 6, line 24, "2" should be --- 6 ---.

Signed and Sealed this

Seventeenth Day of March, 1992

*Attest:*

HARRY F. MANBECK, JR.

*Attesting Officer*

*Commissioner of Patents and Trademarks*